US011466422B1

(12) United States Patent
Hilfiker

(10) Patent No.: US 11,466,422 B1
(45) Date of Patent: Oct. 11, 2022

(54) ADJUSTABLE SINGLE STAGE PANEL SYSTEM AND METHOD

(71) Applicant: Hilfiker Retaining Walls, Eureka, CA (US)

(72) Inventor: Harold K. Hilfiker, Eureka, CA (US)

(73) Assignee: Hilfiker Retaining Walls, Eureka, CA (US)

( * ) Notice: Subject to any disclaimer, the term of this patent is extended or adjusted under 35 U.S.C. 154(b) by 0 days.

(21) Appl. No.: 17/373,138

(22) Filed: Jul. 12, 2021

(51) Int. Cl.
*E02D 29/02* (2006.01)

(52) U.S. Cl.
CPC ..... *E02D 29/0233* (2013.01); *E02D 29/0266* (2013.01); *E02D 2300/002* (2013.01); *E02D 2300/0034* (2013.01); *E02D 2300/0075* (2013.01); *E02D 2600/30* (2013.01)

(58) Field of Classification Search
CPC ..... E02D 29/0233; E02D 29/0266; E02D 2300/002; E02D 2300/0034; E02D 2300/0075; E02D 2600/30; E02D 29/0241; E02D 29/0225
See application file for complete search history.

(56) References Cited

U.S. PATENT DOCUMENTS 4,266,890 A 5/1981 Hilfiker
4,391,557 A 7/1983 Hilfiker et al.
5,002,436 A * 3/1991 Sigourney ..... E02D 29/0266 405/262
5,722,799 A 3/1998 Hilfiker
6,238,144 B1 * 5/2001 Babcock ..... E02D 29/0283 405/262
7,033,118 B2 * 4/2006 Hilfiker ..... E02D 29/0241 405/262
9,493,923 B1 * 11/2016 Miller ..... E02D 29/0225
10,584,461 B1 * 3/2020 Woolbright ..... E02D 29/0266
2011/0182673 A1 7/2011 Taylor
2012/0114431 A1 * 5/2012 Freitag ..... E02D 29/0241 405/302.4
2021/0404137 A1 * 12/2021 Bennani Braouli ..... E02D 29/0225

* cited by examiner

*Primary Examiner* — Carib A Oquendo
(74) *Attorney, Agent, or Firm* — Eric Karich; Karich & Associates

(57) ABSTRACT

A method for constructing a retaining wall using an adjustable single stage panel system has the steps of placing a wall panel adjacent a fill location, then placing a facing wedge adjacent the wall panel, and installing fabric sheet. Next, adding a layer of fill material in the fill location abutting against the facing wedge, and compacting the layer of fill material so that it is compacted against the facing wedge. Then, placing an elongate non-extensible panel anchor on top of the layer of fill material, and attaching the elongate non-extensible panel anchor to the wall panel. At a next step, the facing wedge is moved up to a next course above the layer of fill material, and fabric sheet is installed. An additional layer of fill material is added and compacted with enough force to mobilize the fill. Finally, the method includes the steps of removing the facing wedge, and adjusting the elongate non-extensible panel anchor so that it is plum with the wall panel.

11 Claims, 8 Drawing Sheets

ADJUSTABLE SINGLE STAGE PANEL SYSTEM AND METHOD

BACKGROUND OF THE INVENTION

Field of the Invention

This invention relates generally to retaining walls, and more particularly to an adjustable single stage panel system and method of constructing a retaining wall using this system.

Description of Related Art

The reinforcement of earthen formations by various retaining wall structures is well known in the art. For example, Hilfiker, U.S. Pat. No. 4,391,557, teaches a two stage system wherein an earthen formation is retained by welded wire trays embedded in the formation to effect its reinforcement. A concrete face panel is then cast in place at the face of the formation.

Hilfiker, U.S. Pat. No. 5,722,799, teaches a retaining wall for an earthen formation that uses welded wire face mats having upright portions secured to one another and spanning the distance between successive lifts of the wall at the face of the formation. Elongate welded wire soil reinforcement mats with bent-up ends are secured to the face mats so as to extend partially over the upright portions and into the earthen formation.

Hilfiker, U.S. Pat. No. 4,266,890, teaches a retaining wall having stacked precast stretchers having stacking pads with oppositely disposed slots formed for receipt of connectors Anchor rods are secured to the plates for attachment to embedded anchors.

The prior art teaches two stage systems for reinforcing earthen formations. However, the prior art does not teach a method for constructing a retaining wall using an adjustable single stage panel system. The present invention fulfills these needs and provides further advantages as described in the following summary.

SUMMARY OF THE INVENTION

The present invention teaches certain benefits in construction and use which give rise to the objectives described below.

The present invention provides a method for constructing a retaining wall using an adjustable single stage panel system. The method comprises the steps of placing a wall panel adjacent a fill location, then placing a facing wedge adjacent the wall panel, and installing fabric sheet. Next, adding a layer of fill material in the fill location abutting against the facing wedge, and compacting the layer of fill material so that it is compacted against the facing wedge. Then, placing an elongate non-extensible panel anchor on top of the layer of fill material, and attaching the elongate non-extensible panel anchor to the wall panel. At a next step, the facing wedge is moved up to a next course above the layer of fill material, and fabric sheet is installed. An additional layer of fill material is added and compacted with enough force to mobilize the fill. Finally, the method includes the steps of removing the facing wedge, and adjusting the elongate non-extensible panel anchor so that it is plum with the wall panel.

A primary objective of the present invention is to provide a method for constructing a retaining wall having advantages not taught by the prior art.

Another objective is to provide a method for constructing a retaining wall using an adjustable single stage panel system.

Another objective is to provide an adjustable single stage panel system that uses non-extensible panel anchors.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a method for constructing a retaining wall using an adjustable single stage panel system.

Figure 1:
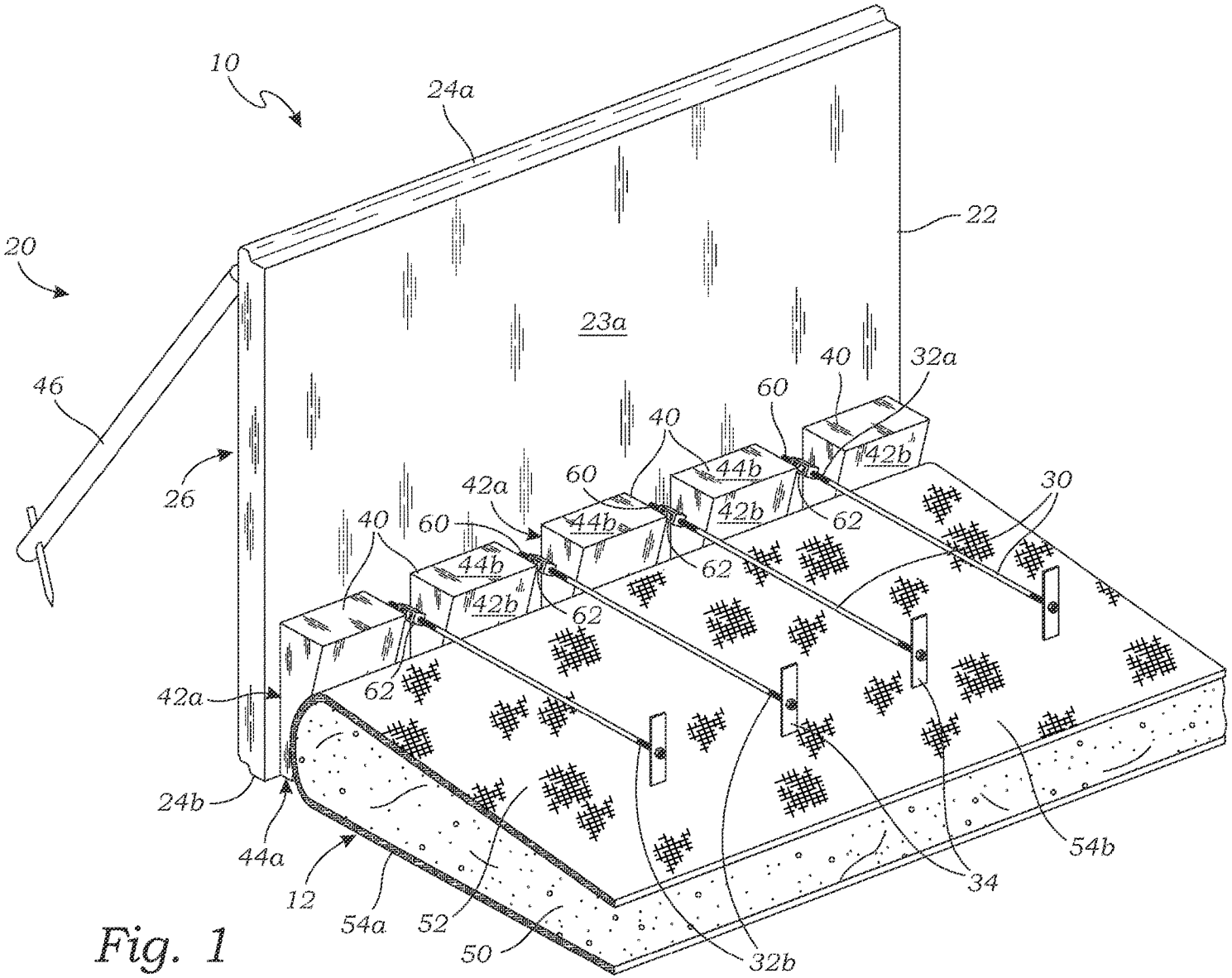
FIG. 1 is a perspective view of a first step of a method for constructing a retaining wall using an adjustable single stage panel system.
Figure 2:
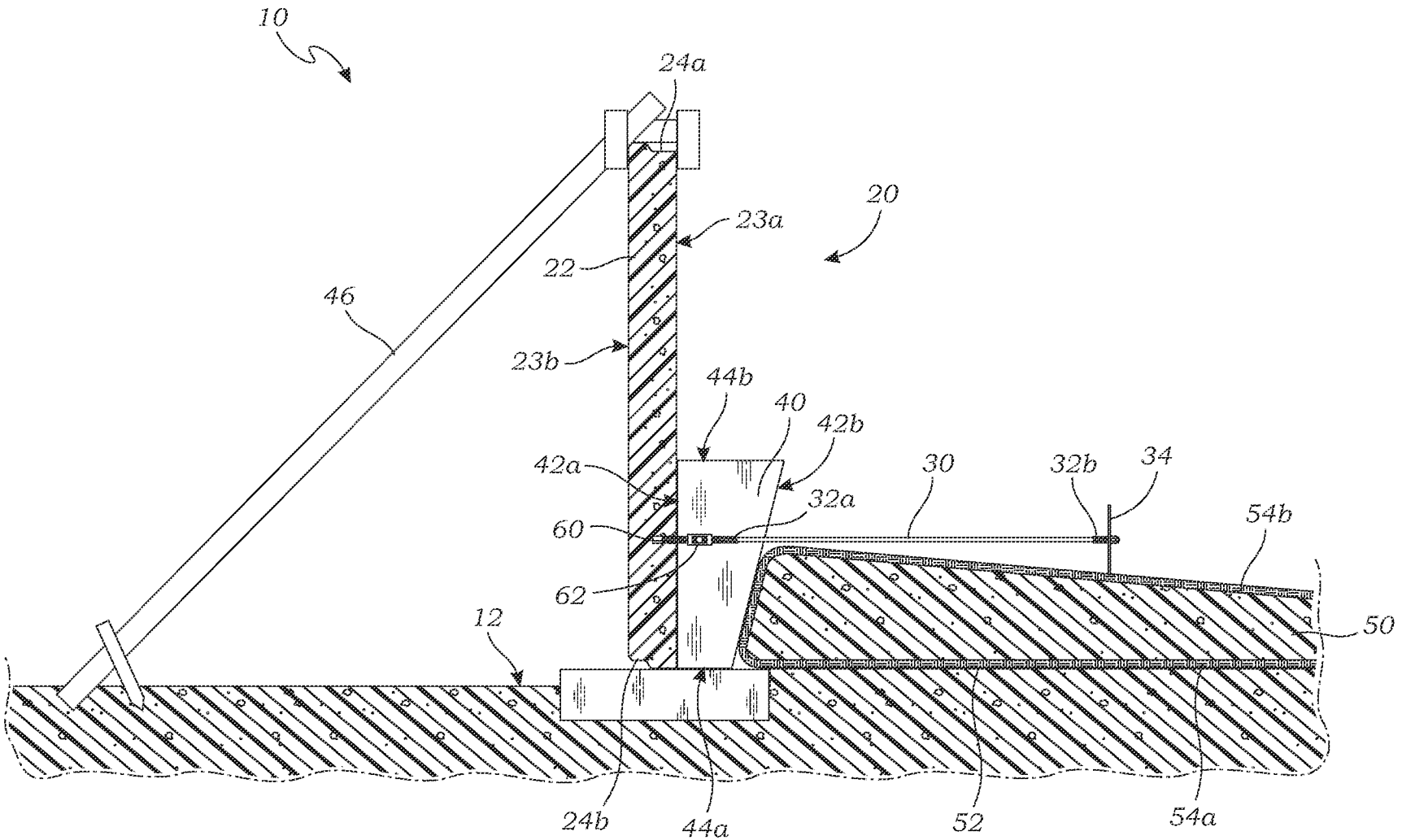
FIG. 2 is a side elevational view of the first step of the method for constructing the retaining wall.

FIG. 1 is a perspective view of an adjustable single stage panel system 10 as it is being used, in a first stage of construction, to construct a retaining wall 20. FIG. 2 is a side elevational view thereof. As shown in FIGS. 1-2, the adjustable single stage panel system 10 includes the use of a vertical wall panel 22 having elongate panel anchors 30 that extend into fill material 50. The adjustable single stage panel system 10 further includes the use of facing wedges 40 that create a gap between the wall panels 22 and the fill material 50, so that the anchors 30 can be adjusted during compacting of the fill material 50.

As shown in FIGS. 1 and 2, the wall panel 22 is first placed adjacent a fill location 12. The wall panel 22 comprises a first face 23*a* and a second face 23*b*, an upper edge 24*a* and a lower edge 24*b* and, wherein the upper and lower edges 24 may be shaped and adapted to engage one another in a stacked position (best shown in FIGS. 4-6, and discussed below). A bracing 46 may be used to support the wall panel 22 during construction.

Figure 8:
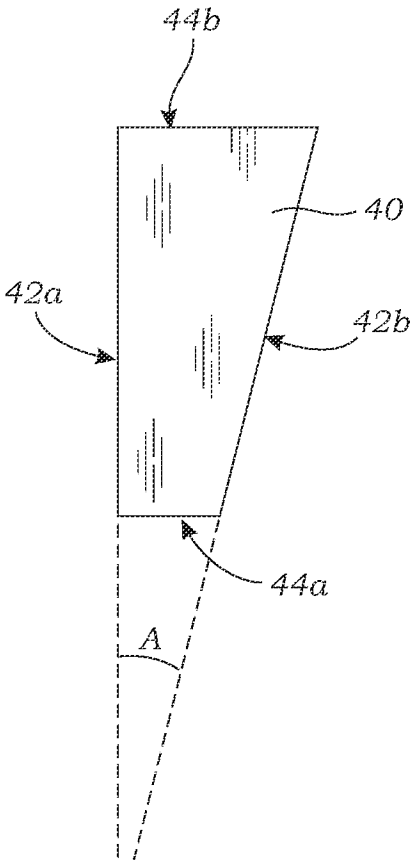
FIG. 8 is a side elevational view of a facing wedge used in the method.

A plurality of the facing wedges 40 are placed adjacent the wall panel 22 against the first face 23*a* of the wall panel 22, for providing space between the wall panel 22 and the earthen fill as it is added. In this embodiment, the facing wedge 40 has a rear surface 42*a* that is shaped to abut the wall panel 22, and further includes a front surface 42*b* that is spaced a distance from the rear surface 42*a* for creating a gap. The front surface may be positioned at an angle A (as shown in FIG. 8) of approximately 5-40 degrees with respect to the rear surface 42*a*, in this case approximately 16 degrees. This angled construction facilitates removal of the wedges once the fill material has been added and compacted.

The facing wedge 40 may include a bottom surface 44*a* and a top surface 44*b*. The top surface 44*b* in this embodiment may typically be approximately 10-20 inches, in this case approximately 18 inches. From the same view, the bottom surface 44*a* may be between approximately 5-10 inches, in this embodiment approximately 8 inches. Obviously, the size of the top surface 44*b*, the bottom surface 44*a*, and the degree of the angle A will vary depending upon the requirements determined by one skilled in the art, and the present invention anticipates a wide range of potential sizes and shapes.

As shown in FIG. 1, the plurality of the facing wedges 40 are typically placed along the width of the wall panel 22, for providing the necessary gap adjacent the wall 20, with spaces between the wedges 40 for attaching the elongate panel anchors 30.

Once the wedges 40 are in place, a fabric sheet 52 may be positioned over the ground adjacent the wall panel 22, for receiving the fill material. For the purposes of this application, the term "fabric sheet" is defined to include any sheet of material capable of functioning as described herein, including a grid, mesh, netting, cloth, tarp, etc., or any similar sheets of material known in the art for use with earthen fill. Furthermore, the fabric sheet 52 in its various forms may be constructed of any suitable materials, e.g., cotton or other organic fiber, synthetic fibers, plastics, metals, etc., a combination of these, or any other suitable materials known in the art.

In this embodiment, the fabric sheet 52 is placed in front of the facing wedge 40 such that a first end 54*a* is on the ground, and a second end 54*b* may be folded over the first end 54*a*. The fill material 50 is then added in the fill location 12 on top of the fabric sheet 52, up to and abutting the facing wedge 40. The fill material 50 may comprise any materials typically used in similar construction methods, e.g., any form of earth, coarse or fine grained soil, rock, aggregate, crushed paving material, etc., or alternative commercial products.

Once the fill material 50 has been added, the fabric sheet 52 is folded over, and the layer of fill material 50 is compacted. The fill material 50 should be compacted with enough force to mobilize the fill and tension the fabric or grid. Uneven or excessive settling of the fill material 50, from insufficient compacting, can result in damage to the system 10. The second end of the fabric sheet 52 may be folded over the fill material 50 before and/or after compacting. In alternative implementations, i.e., wherein the sheet of fabric is not a sufficient length, an additional fabric sheet 52 may instead be placed on top of the compacted fill material 50, or the fill material 50 may remain uncovered until the steps shown in FIG. 3, discussed below. The compacting step together with the fabric sheet 52 may serve to prevent the fill material 50 from later settling and from shifting.

The elongate panel anchors 30 are then placed on top of the layer of fill material 50, in this embodiment on top of the sheet of fabric, and attached to the wall panel 22. In some embodiments, each panel anchor 30 is constructed of a non-extensible material, e.g., steel, although in alternative embodiments the anchors 30 may be extensible plastic or other material known in the art. Each anchor 30 extends from a proximal end 32*a* to a distal end 32*b*. The proximal end 32*a* is adapted for attachment to the wall panel 22, and the distal end 32*b* is adapted to extend into the fill. In this embodiment, the distal end 32*b* includes an endpiece 34. The endpiece 34 may be in the form of a plate, rod, or any similar endpiece typically associated with panel anchors 30, positioned to be generally perpendicular to the panel anchor 30. Alternatively, the distal end 32*b* may not include the endpiece 34.

Figure 10:
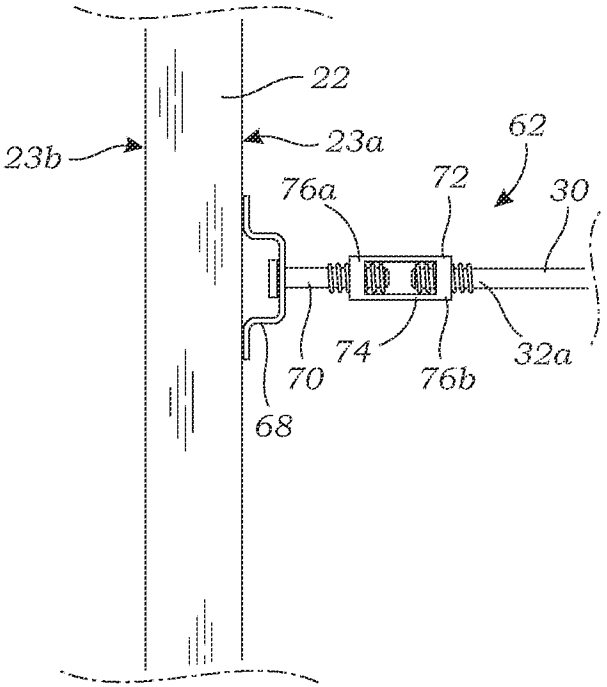
FIG. 10 is a side elevational view of the retaining wall, showing an alternative means for adjusting the panel anchor.
Figure 9:
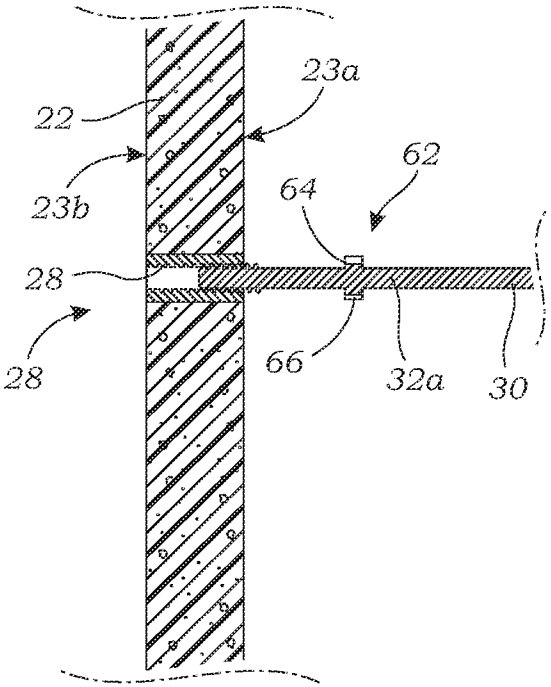
FIG. 9 is a sectional view of the retaining wall, illustrating a means for adjusting a panel anchor.

The panel anchor 30 may be attached to the wall panel 22 at the proximal end 32*a* via an attachment mechanism 60, wherein the attachment mechanism 60 includes a means for adjusting 62 each elongate non-extensible panel anchor 30. Examples of the attachment mechanism 60 and the means for adjusting 62 are shown in FIGS. 9-10 and discussed at length below.

Figure 3:
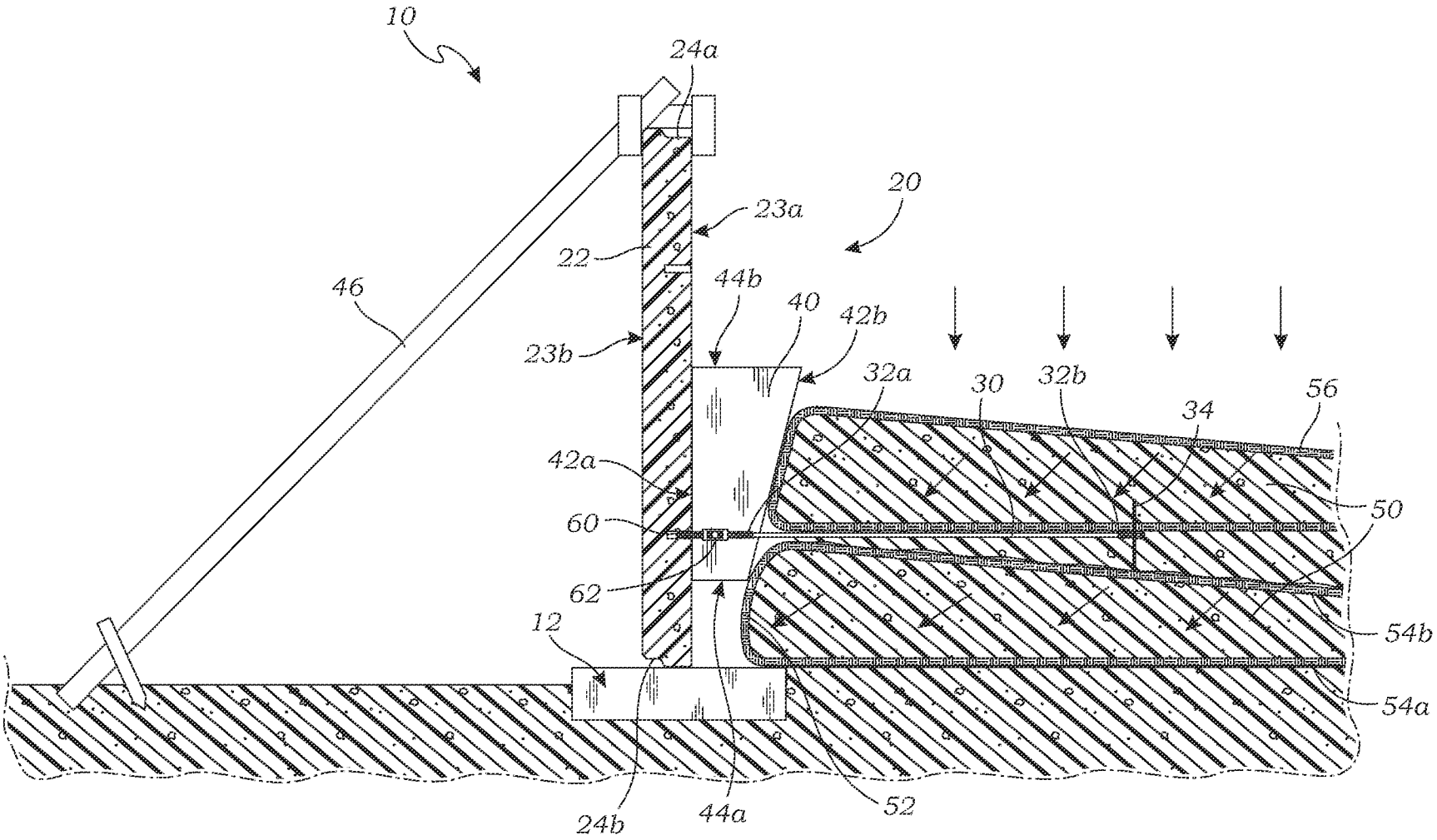
FIG. 3 is a side elevational view of a second step of the method for constructing the retaining wall.

FIG. 3 is a side elevational view of the system 10 during a second series of steps of the method for constructing the retaining wall 20. As shown in FIG. 3, after attaching the elongate non-extensible panel anchor 30 to the wall panel 22, the facing wedge 40 is moved up to a next course above the layer of fill material 50. Next, an additional fabric sheet 56 is installed on top of the panel anchor 30, and an additional layer of fill material 50 is added in the fill location 12 abutting against the adjusted facing wedge 40. As previously described, the additional layer of fill material 50 is then compacted so that it compacted against the facing wedge 40, with enough force to mobilize the fill.

Figure 4:
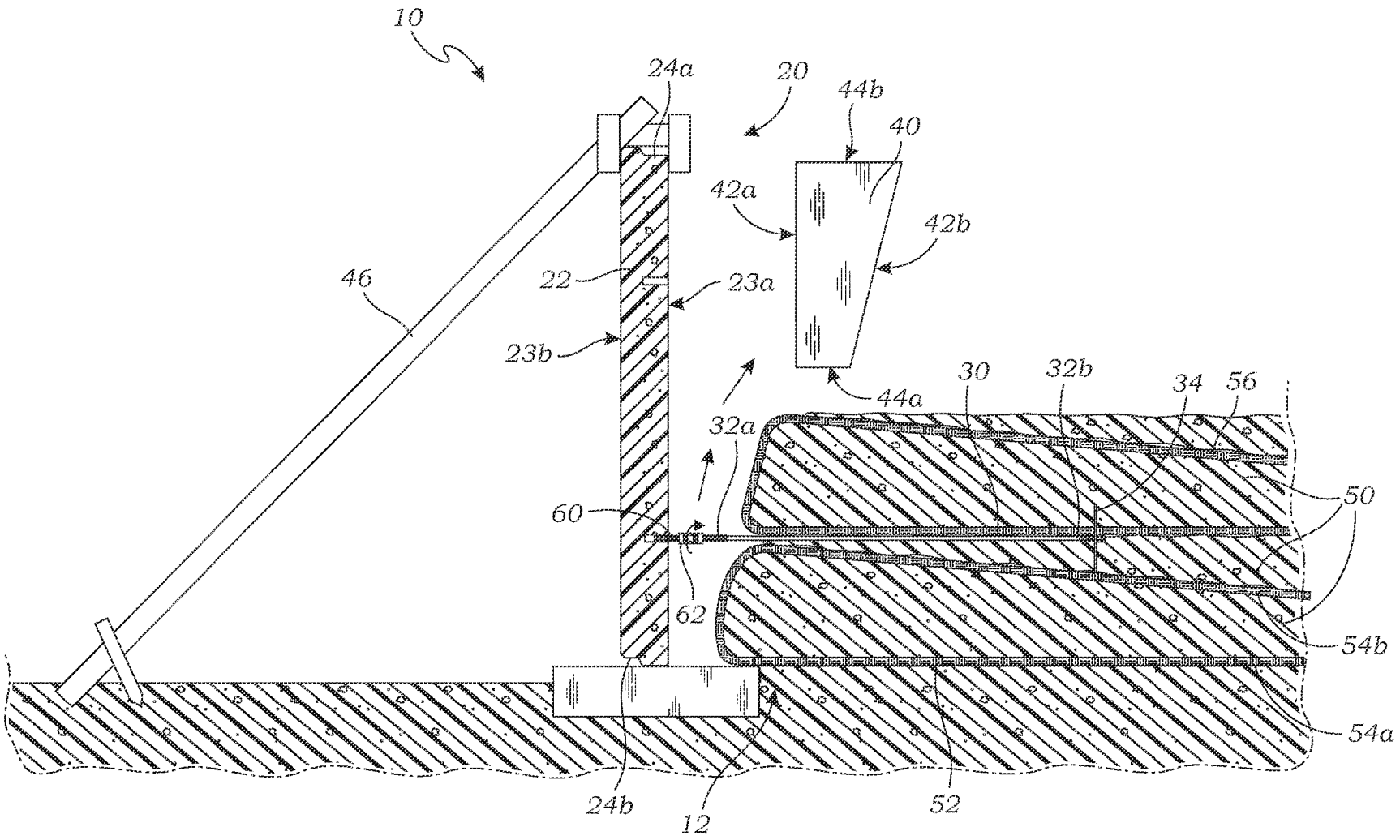
FIG. 4 is a side elevational view of a third step of the method for constructing the retaining wall.

FIG. 4 is a side elevational view illustrating a third step of the method for constructing the retaining wall 20. After the steps of FIG. 3, the elongate panel anchors 30 may have shifted due to the compacting steps, so the next steps include the removal of the facing wedge 40 to allow the panel anchor 30 to be adjusted using the means for adjusting 62. After adjusting, the elongate panel anchors 30 should be plum with the wall panel 22, and in this embodiment, preferably generally horizontal for supporting the additional layer of fill material 50.

Figure 5:
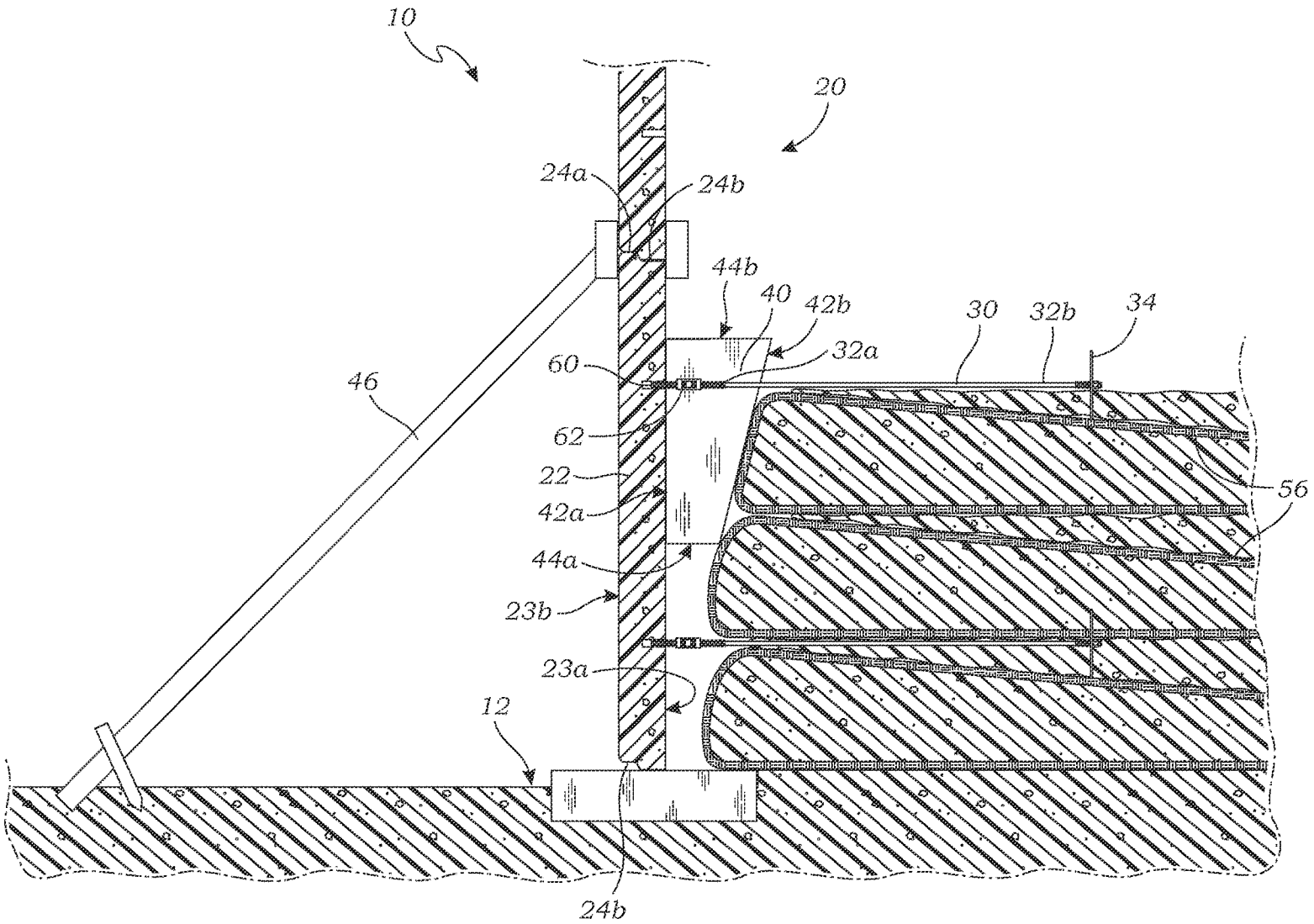
FIG. 5 is a side elevational view of a fourth step of the method for constructing the retaining wall.

FIG. 5 is a side elevational view of a fourth set of steps of the method for constructing the retaining wall 20. As shown in FIG. 5, a next step of the method includes adding layers of fill material 50 and elongate non-extensible panel anchors 30 in the manner described above until the fill material 50 reaches the height of the wall panel 22. As shown in FIG. 5, in some embodiments, the additional fabric sheets 56 having the fill material 50 may be stacked in a plurality on top of each other before adding another panel anchor 30. Alternatively, a panel anchor 30 may be added after each layer of fill material 50. In some embodiments, as shown in FIG. 5, fill material 50 may also be added on top of the second ends 54*b* of the fabric sheets 52 and 56, or alternatively may only be added within each single sheet.

Next, the lower edge 24*b* of a second wall panel 26 is mounted on the upper edge of the wall panel 22 already installed, wherein the upper and lower edges 24 may be shaped and adapted to engage one another in a stacked position. A securing mechanism (not shown) may be used to further secure the upper and lower edges 24 so the second wall panel 26 does not fall off of the top of the prior (e.g., a bolt, clamp, adhesive, etc.), but the securing mechanism may not be needed for the purposes of the method.

Figure 6:
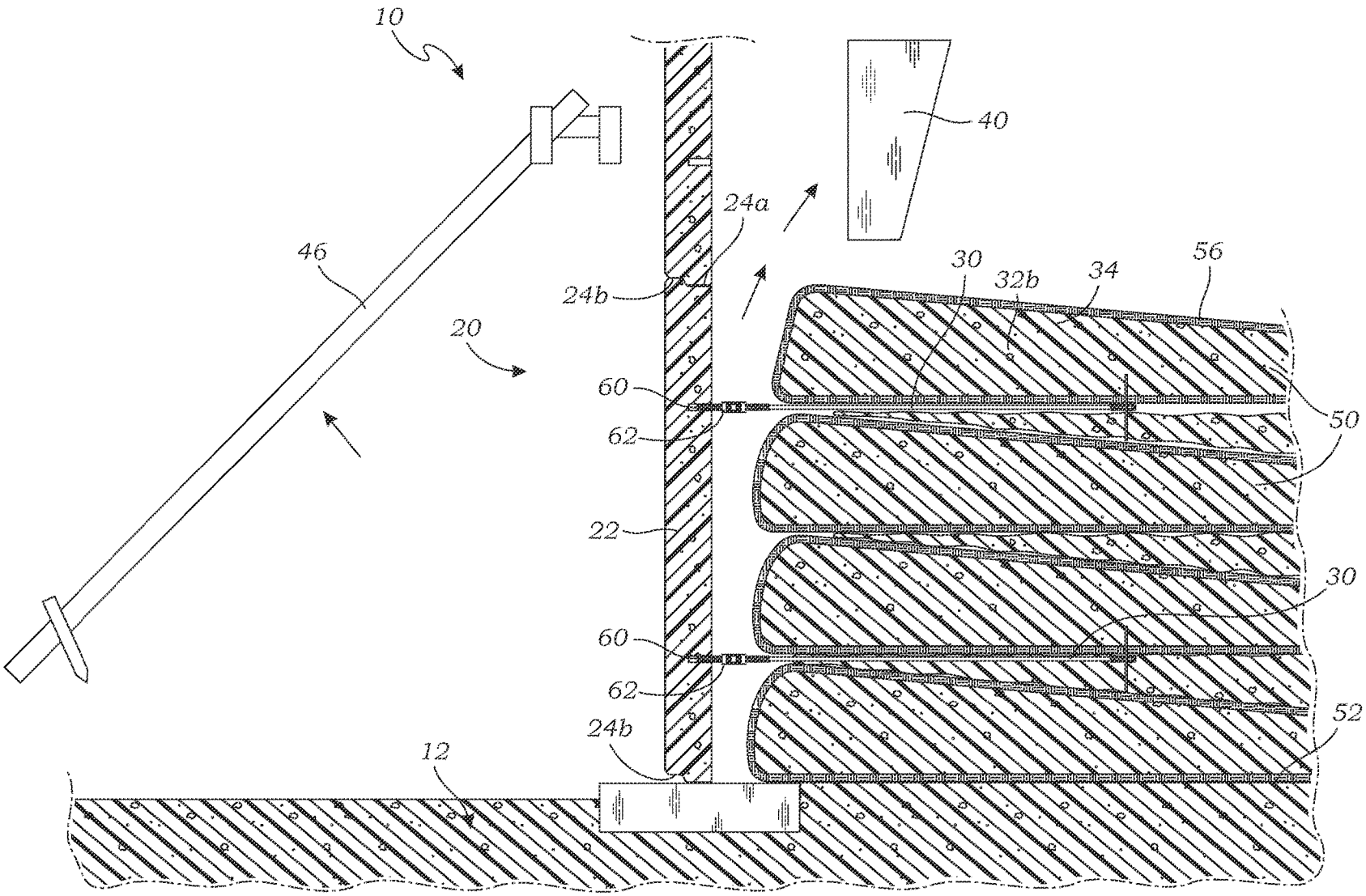
FIG. 6 is a side elevational view of a fifth step of the method for constructing the retaining wall.

FIG. 6 is a side elevational view of a fifth set of steps of the method for constructing the retaining wall 20. As shown in FIG. 6, in some embodiments, the next steps include adding successive layers of fill material 50 and elongate non-extensible panel anchors 30 until the fill material 50 reaches the height of the second wall panel 26. The facing wedge(s) 40 may then be removed altogether, and in some applications of the method, the bracing 46 is also removed at this stage. Alternatively, the fill material 50 may be added until it reaches a different desired height i.e., only the height of the first wall panel 22, or a different height (e.g., two-thirds the height of either panel, etc.), as determined by one skilled in the art.

Figure 7:
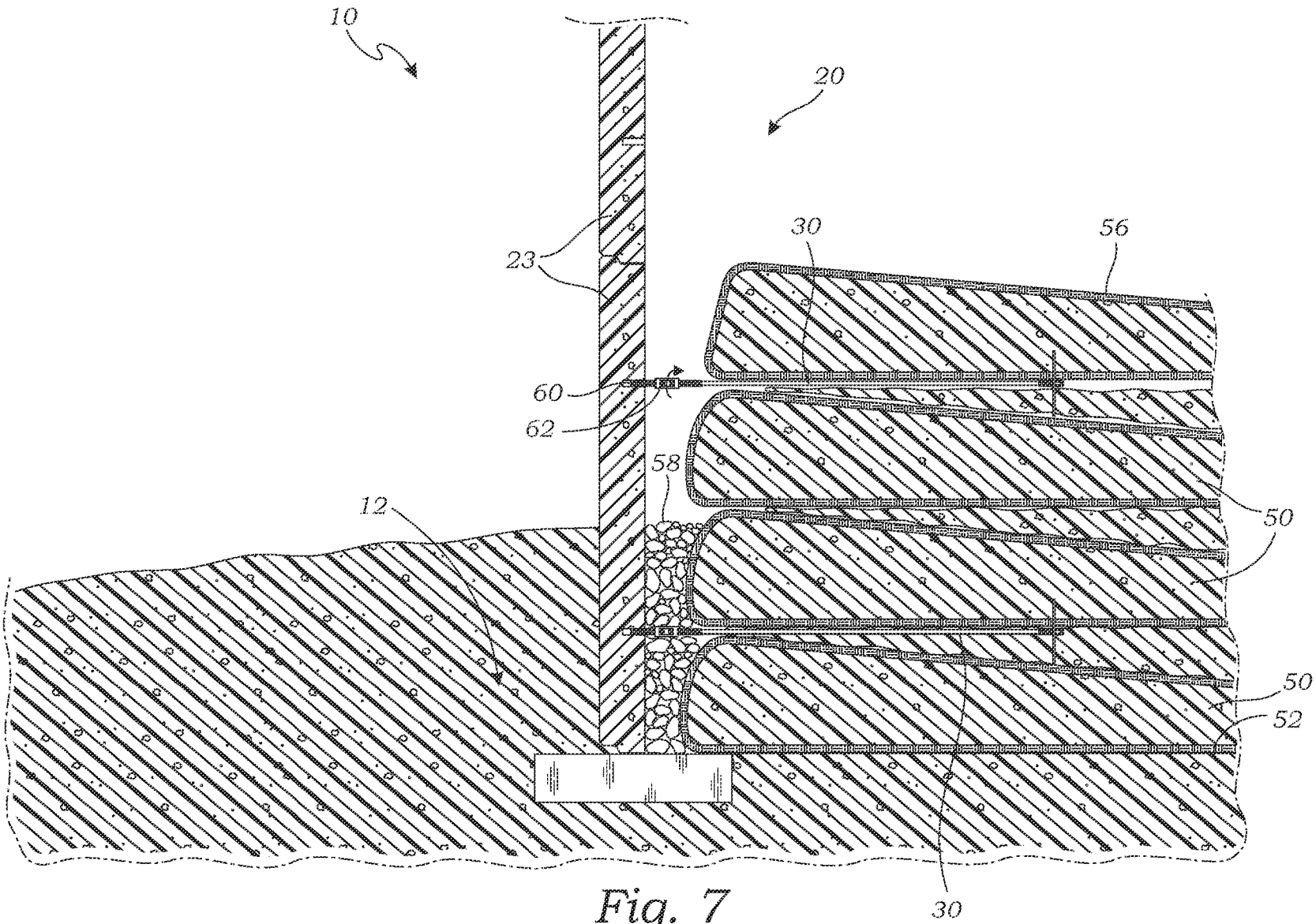
FIG. 7 is a side elevational view of a sixth step of the method for constructing the retaining wall.

FIG. 7 is a side elevational view of a sixth set of steps of the method for constructing the retaining wall 20. As shown in FIG. 7, after the final layer of fill material 50, the panel anchor 30 are adjusted for alignment in the manner described above. In some embodiments, after removing the facing wedge(s) 40, drain rock 58 may be placed in the spaces left by the facing wedge(s) 40 to finish grade elevation. In other embodiments, different materials may be used to fill the spaces, or they may be left empty. As shown in FIG. 7, in some embodiments, at this stage of the method, the fill location 12 may receive additional fill material surrounding the wall panel 23.

FIG. 8 is a side elevational view of the facing wedge 40 used in the method. As discussed above, in this embodiment, the facing wedge 40 has the rear surface 42*a* that is shaped to abut the wall panel 22, and further includes the front surface 42*b* that is positioned at an angle A with respect to the rear surface 42*a*. As shown in FIGS. 2-8, the facing wedge 40 may also include the bottom surface 44*a* and the top surface 44*b*.

FIG. 9 is a sectional view of the wall panel 22, illustrating one embodiment of the attachment mechanism 60 having the means for adjusting 62 the panel anchor 30. As shown in FIG. 9, in this embodiment, the attachment mechanism 60 comprises an internally threaded insert 28 placed at the desired locations within the wall panel 22 for receiving the proximal end 32*a* of each of the panel anchors 30, wherein each proximal end 32*a* is externally threaded. In this embodiment, the means for adjusting 62 the panel anchor 30 is in the form of a nut 64 adjacent the proximal end 32*a* having a faceted outer surface 66 adapted to be gripped by a tool such as a wrench (or similar), such that after the panel anchors 30 and layers of fill material 50 have been added to the fill location 12 and the facing wedge(s) 40 removed, the nut 64 may be rotated to tighten the panel anchor 30 within the internally threaded insert 28. In other embodiments, the attachment mechanism 60 and means for adjusting 62 may be in a different form, a second example being shown in FIG. 10 and discussed in detail below.

FIG. 10 is a side elevational view of the wall panel 22, showing an alternative means for securing the panel anchor 30. As shown in FIG. 10, in this embodiment, the attachment mechanism 60 is in the form of a bracket 68 secured to the wall panel 22 at the desired locations (i.e., bolted to the wall panel 22, though any securing means may be used), wherein the bracket 68 has an outwardly extending externally threaded shank 70.

In such an embodiment, the means for adjusting 62 the panel anchor 30 is in the form of a turnbuckle 72, wherein the turnbuckle 72 comprises a faceted outer surface 74, a first end 76*a*, and a second end 76*b*. The first and second ends 76 of the turnbuckle 72 are each internally threaded, wherein the threads of the first end 76*a* are formed in the opposite direction of the threads of the second end 76*b*. The first end 76*a* is sized and adapted to receive the externally threaded shank 70 of the bracket 68, and the second end 76*b* is sized and adapted to receive the proximal end 32*a* of the panel anchor 30, wherein the proximal end 32*a* is threaded. Thereby, to adjust the positioning of the panel anchor 30, the faceted outer surface 74 of the turnbuckle 72 may be gripped and rotated such that distance between the proximal end 32*a* of the panel anchor 30 and the externally threaded shank 70 of the bracket 68 is reduced or increased.

While two examples of the attachment mechanism 60 and the means for adjusting 62 the panel anchors 30 are disclosed herein, it should be understood that a wide variety of attachment mechanisms 60 and means for adjusting 62 are included in the scope of the present invention. For example, the attachment mechanism 60 may be attached to the wall panel 22 using any mechanism known in the art, or the wall panel 22 may have an insert that receives resilient/foldable prongs of the attachment mechanism 60 that open plum to the second face 23*b* of the wall panel 22 to secure the attachment mechanism 60 in place. Any other attachment mechanisms may be included, as is well known to those in the art. Furthermore, the means for adjusting 62 the panel anchors 30 may also be in other forms compatible with the claims of the present invention, e.g., a ratchet device, clamp, etc. In some embodiments, an insert of the wall panel 22 may extend through the wall panel 22 (i.e., as shown in FIG. 9), wherein the means for adjusting 62 may be placed adjacent the second face 23*b* of the wall panel 22 for adjusting the positioning of the panel anchors 30. Obviously, any other suitable means for adjusting 62 may be implemented, as determined by one skilled in the art.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A method for constructing a retaining wall using an adjustable single stage panel system, the method comprising the steps of:

placing a wall panel adjacent a fill location;

placing a facing wedge adjacent the wall panel;

installing fabric sheet;

adding a layer of fill material in the fill location abutting against the facing wedge;

compacting the layer of fill material so that it is compacted against the facing wedge;

placing an elongate panel anchor on top of the layer of fill material;

attaching the elongate panel anchor to the wall panel;

moving the facing wedge up to a next course above the layer of fill material;

installing a fabric sheet;

adding an additional layer of fill material in the fill location abutting against the facing wedge;

compacting the additional layer of fill material so that it compacted against the facing wedge, with enough force to mobilize the fill;

removing the facing wedge; and adjusting the elongate panel anchor so that it is plum with the wall panel.

2. The method of claim 1, wherein the wall panel is a concrete panel.

3. The method of claim 1, further comprising the steps of adding layers of fill material and elongate panel anchors until the fill material reaches the height of the wall panel.

4. The method of claim 3, further comprising the steps of:

mounting a second wall panel on top of the wall panel already installed; and adding successive layers of fill material and elongate panel anchors until the fill material reaches the height of the second wall panel.

5. The method of claim 1, wherein the facing wedge has a rear surface that is shaped to abut the wall panel, and further includes a front surface that is positioned at an angle of 5-40 degrees with respect to the rear surface.

6. The method of claim 1, wherein the facing wedge has a rear surface that is shaped to abut the wall panel, and further includes a front surface that is positioned at an angle of approximately 16 degrees with respect to the rear surface.

7. The method of claim 1, wherein the facing wedge includes a top surface and a bottom surface, which, from a side elevational view, are between approximately 10-20 inches, and 5-10 inches, respectively.

8. The method of claim 1, wherein the wall panel comprises first face and a second face, and a lower edge and an upper edge, wherein the upper and lower edges may be shaped and adapted to engage one another in a stacked position.

9. The method of claim 1, wherein the panel anchor may be attached to the wall panel via an attachment mechanism, the attachment mechanism having a means for adjusting each elongate non-extensible panel anchor's positioning.

10. The method of claim 1, wherein the panel anchor is non-extensible.

11. The method of claim 1, wherein the panel anchor is steel.

* * * * *